US010954103B2

(12) United States Patent
Park

(10) Patent No.: US 10,954,103 B2
(45) Date of Patent: Mar. 23, 2021

(54) PEOPLE CONVEYOR AND METHOD OF DETERMINING POWER FOR DRIVING A HANDRAIL ELEMENT OF A PEOPLE CONVEYOR

(71) Applicant: Otis Elevator Company, Farmington, CT (US)

(72) Inventor: Chan-Jong Park, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/163,209

(22) Filed: Oct. 17, 2018

(65) Prior Publication Data

US 2019/0112161 A1 Apr. 18, 2019

(30) Foreign Application Priority Data

Oct. 18, 2017 (EP) ..... 17197072

(51) Int. Cl.

| | |
|---|---|
| ***B66B 23/26*** | (2006.01) |
| ***B66B 23/04*** | (2006.01) |
| ***B66B 25/00*** | (2006.01) |
| ***B66B 23/20*** | (2006.01) |

(52) U.S. Cl.

CPC ..... *B66B 23/26* (2013.01); *B66B 23/04* (2013.01); *B66B 23/20* (2013.01); *B66B 25/003* (2013.01); *B66B 25/006* (2013.01)

(58) Field of Classification Search

CPC ..... B66B 23/26; B66B 23/04; B66B 23/20; B66B 23/24; B66B 25/003; B66B 25/006; B66B 25/00

See application file for complete search history.

(56) References Cited

U.S. PATENT DOCUMENTS 2,646,868 A * 7/1953 Eames ..... B66B 23/04 198/323
3,651,919 A * 3/1972 Vollmer ..... B66B 23/04 198/331

(Continued)

FOREIGN PATENT DOCUMENTS

CN 101613052 A 12/2009
CN 201777767 U 3/2011

(Continued)

OTHER PUBLICATIONS

European Search Report for application EP 17197072.6, dated Apr. 20, 2018, 6 pages.

*Primary Examiner* — William R Harp
(74) *Attorney, Agent, or Firm* — Cantor Colburn LLP

(57) ABSTRACT

A people conveyor (2), which is configured for conveying passengers by at least one conveyance band (8) travelling along a closed loop, comprises at least one handrail element (6) which is configured for moving parallel to the at least one conveyance band (8) along a travel path forming a closed loop; and at least one force sensor (18*a*, 18*b*), which is configured for detecting a force ($F_{S1}$, $F_{S2}$) exerted by the at least one handrail element (6) in a direction transverse to the direction of movement of the at least one handrail element (6) and for providing a corresponding force signal.

18 Claims, 2 Drawing Sheets

(56) References Cited

U.S. PATENT DOCUMENTS

| | | | | | |
|---|---|---|---|---|---|
| 5,123,284 | A | * | 6/1992 | Edinburgh | G01L 5/10 73/159 |
| 5,188,209 | A | * | 2/1993 | Johnson | B66B 23/20 198/336 |
| 5,295,567 | A | * | 3/1994 | Zaharia | B66B 29/04 198/323 |
| 5,566,810 | A | * | 10/1996 | Meyer | B66B 23/04 198/331 |
| 5,782,333 | A | | 7/1998 | Pitts | |
| 5,785,165 | A | | 7/1998 | Stahlhut et al. | |
| 5,842,554 | A | | 12/1998 | Stoexen et al. | |
| 8,061,215 | B2 | | 11/2011 | Caunce et al. | |
| 10,065,839 | B2 | * | 9/2018 | Park | B66B 23/04 |
| 10,227,215 | B2 | * | 3/2019 | Park | B66B 25/006 |
| 2003/0136635 | A1 | | 7/2003 | Lauch | |
| 2012/0289866 | A1 | | 11/2012 | Irby et al. | |

FOREIGN PATENT DOCUMENTS

| | | | | |
|---|---|---|---|---|
| CN | 102398843 | A | | 4/2012 |
| CN | 103387177 | A | | 11/2013 |
| DE | 3611597 | A1 | | 10/1987 |
| JP | 04089791 | A | * | 3/1992 |
| JP | 2006151662 | A | | 6/2006 |
| KR | 20010009969 | A | | 2/2001 |

* cited by examiner

PEOPLE CONVEYOR AND METHOD OF DETERMINING POWER FOR DRIVING A HANDRAIL ELEMENT OF A PEOPLE CONVEYOR

BACKGROUND

The application is related to a people conveyor and to a method of determining power for driving a handrail element of a people conveyor.

People conveyors, such as escalators and moving walkways, usually comprise a conveyance band, which is configured for conveying passengers, and at least one handrail element moving parallel to the conveyance band.

The power necessary for driving the handrail element contributes considerably to the total power needed for driving the people conveyor.

Problems with the handrail element may increase the power necessary for driving the handrail element and/or decrease the lifetime of the handrail element.

It therefore would be beneficial to provide a people conveyor and a method which allow monitoring in real-time the power which is necessary for driving the handrail.

SUMMARY

According to an exemplary embodiment of the invention a passenger conveyor is configured for conveying passengers by at least one conveyance band travelling along a travel path forming a closed loop. The passenger conveyor comprises at least one handrail element which is configured for moving parallel to the at least one conveyance band along a travel path forming a closed loop; and at least one force sensor. The at least one force sensor is configured for detecting a force which is exerted by the at least one handrail element in a direction transverse to the direction of movement of the at least one handrail element and for providing a corresponding force signal.

According to an exemplary embodiment of the invention, a method of determining the power which is necessary for driving the at least one handrail element of a people conveyor includes: driving the at least one handrail element; detecting a force which is exerted by the at least one handrail element in a direction transverse to the direction of movement of the at least one handrail element; and calculating from said detected force a driving power, which is necessary for driving the at least one handrail element.

The passenger conveyor and the method according to exemplary embodiments of the invention allow for remote preventive maintenance by monitoring the handrail driving power in real-time without stopping and/or disassembling the people conveyor. Unusual conditions of the at least one handrail element or its driving mechanism may be detected early and countermeasures may be taken before further damage occurs. Energy consumption is reduced and lifetime of the handrail element is increased since the handrail element can be driven with minimum power.

A number of optional features are set out in the following. These features may be realized in particular embodiments, alone or in combination with any of the other features.

The people conveyor may comprise a handrail power calculation unit, which is configured for calculating the driving power which is necessary for driving the at least one handrail element based on at least one force signal provided by the at least one force sensor.

The at least one force sensor may be arranged at a curved portion of the travel path of the at least one handrail element.

Arranging the at least one force sensor at a curved portion of the travel path allows determining the power needed for driving the at least one handrail element with high accuracy. The at least one handrail element in particular may be guided at least partly by the at least one guide rail and the at least one force sensor may be configured for detecting the force which is exerted by the at least one handrail element onto said guide rail.

The at least one force sensor may be configured for detecting a force which is oriented in a plane defined by the travel path of the at least one handrail element. The force may be detected in a direction which is transverse, in particular orthogonal, to the direction of movement of the at least one handrail element. A force which is oriented in a plane defined by the travel path of the at least one handrail element, in particular a force which is oriented transversely or, more particularly, orthogonally to the direction of movement of the at least one handrail element, reliably represents the power needed for driving the at least one handrail element.

The at least one guide rail may be provided with rollers supporting and guiding the at least one handrail element for reducing the friction between the guide rail and the at least one handrail element.

The travel path may comprise a conveying portion and a return portion, and the at least one force sensor may be arranged at the conveying portion or at the return portion of the at least one handrail element. As the return portion usually is not visible or accessible by the passengers, the at least one force sensor may be arranged at the return portion without deteriorating the appearance of the people conveyor. Further, a force sensor which is arranged at the return portion is protected from manipulations and damage by passengers.

The at least one handrail element may be a belt, in particular a synthetic belt. A (synthetic) belt provides a suitable and durable handrail element. The principle, however, is not limited to a synthetic belt. Instead, it is applicable to all types of closed loop handrail elements which needs a certain tension for operation.

The at least one force sensor may include a load cell or a strain gauge. Load cells and strain gauges are available as standard components providing cheap and reliable force sensors generating sensor signals of sufficient accuracy, respectively. The at least one force sensor may be any mechanical or electrical device which is capable of detecting forces exerted by the at least one handrail element in a direction transverse to the direction of movement of the at least one handrail element.

The people conveyor may comprise a handrail drive, which is configured for driving the at least one handrail element. The people conveyor may further comprise at least two force sensors. With respect to the direction of movement of the handrail element, a first force sensor may be arranged on one side of the handrail drive and a second force sensor may be arranged on the other side of the handrail drive. In other words, when moving along its travel path, a section of the at least one handrail element may pass one of the force sensors before it passes the handrail drive, and it may pass another one of the force sensors after it passed the handrail drive.

Thus, a section of the at least one handrail element always passes one of the force sensors before it passes the handrail drive independently of the direction of movement of the handrail element. This allows detecting and evaluating the force exerted by the at least one handrail element always at a position upstream (before) of the handrail drive, independently of the direction of movement of the handrail drive. As a result, the power needed for driving the handrail drive may be determined with high accuracy for both directions of movement of the handrail.

The people conveyor may comprise two handrail elements, wherein one handrail element is arranged on each lateral side of the at least one conveyance band, respectively. This allows passengers to rest their hands on both sides of the people conveyor.

The people conveyor may be an escalator comprising a plurality of steps forming the conveyance band. Alternatively, the people conveyor may be a moving walkway comprising a plurality of pallets forming the conveyance band.

DRAWING DESCRIPTION

In the following an exemplary embodiment of the invention is described with reference to the enclosed figures.

DETAILED DESCRIPTION

Figure 1:
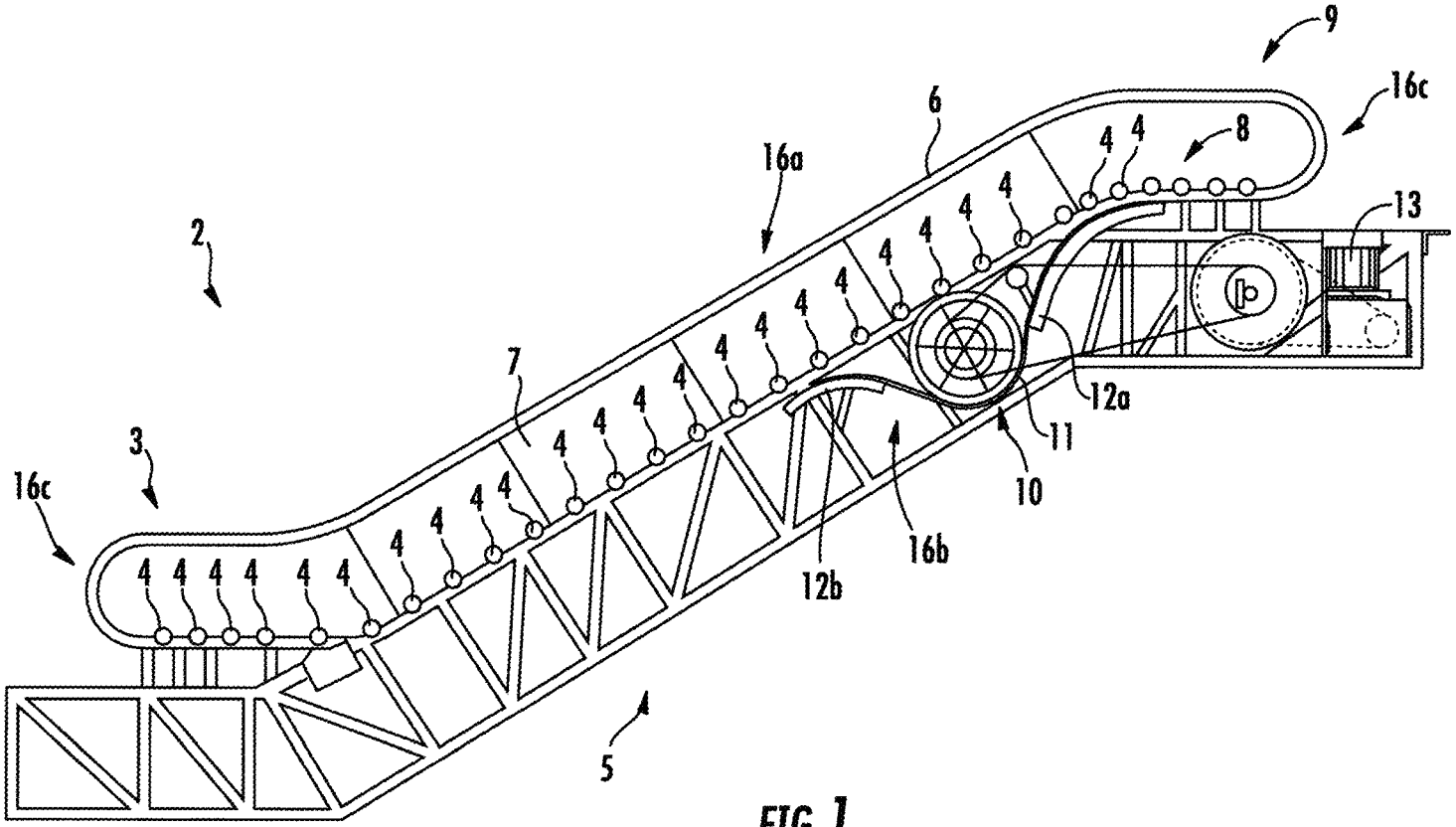
FIG. 1 shows a schematic side view of a people conveyor to which the exemplary embodiments of the invention may be applied.

FIG. 1 shows a schematic side view of a people conveyor 2 according to an exemplary embodiment of the invention. The people conveyor 2 shown in FIG. 1 is an escalator comprising a plurality of conveyance elements (steps) 4, which are depicted only schematically. The people conveyor 2 shown in FIG. 1 comprises a truss 5 extending in a conveyance direction between a lower landing zone 3 and an upper landing zone 9.

The truss 5 supports a chain of conveyance elements (steps) 4 forming a conveyance band 8. Two balustrades 7 extend parallel to the conveyance band 8, but only one balustrade 7 is visible in FIG. 1. The balustrades 7 reside laterally at both sides of the conveyance elements 4 respectively supporting a moving handrail element 6.

Although the people conveyor 2 shown in FIG. 1 is an escalator, the skilled person will understand that the ideas and principles described in the following may be applied similarly to horizontal and inclined moving walkways comprising pallets instead of steps 4 and to any other types of people conveyors 2 comprising at least one moving handrail element 6.

In the following, the description predominantly refers only to a single handrail element 6. However, the skilled person will understand that the described features and principles may be applied to a second handrail element 6, which is arranged on the other side of the conveyance band 8, as well.

The handrail element 6 is configured for moving along a closed travel path (loop) extending parallel to the truss 5. The travel path extends in a plane which is parallel to the plane of FIG. 1 and it comprises an upper conveying portion 16*a* and a lower return portion 16*b*. At the landing zones 3, 9, the conveying portion 16*a* and the lower return portion 16*b* are connected by turnaround portions 16*c*.

In the lower return portion 16*b*, the handrail element 6 runs over a handrail drive 10, in particular a portion of a drive wheel 11, which is in frictional and/or structural engagement with the handrail element 6. The handrail drive 10 is driven by a motor 13 for driving the handrail element 6.

The handrail element 6 and the conveyance band 8 may be driven by the same motor 13. Alternatively, separate motors 13 may be employed for driving the handrail element 6 and the conveyance band 8, respectively. Similarly, two handrail elements 6, which are provided on the two lateral sides of the conveyance band 8, may be driven by the same motor 13 or by separate motors 13.

Next to the drive wheel 11, the handrail element 6 is guided by a first guide rail 12*a* and by a second guide rail 12*b*. An enlarged view of the area close to the drive wheel 11 is shown in FIG. 2.

Figure 2:
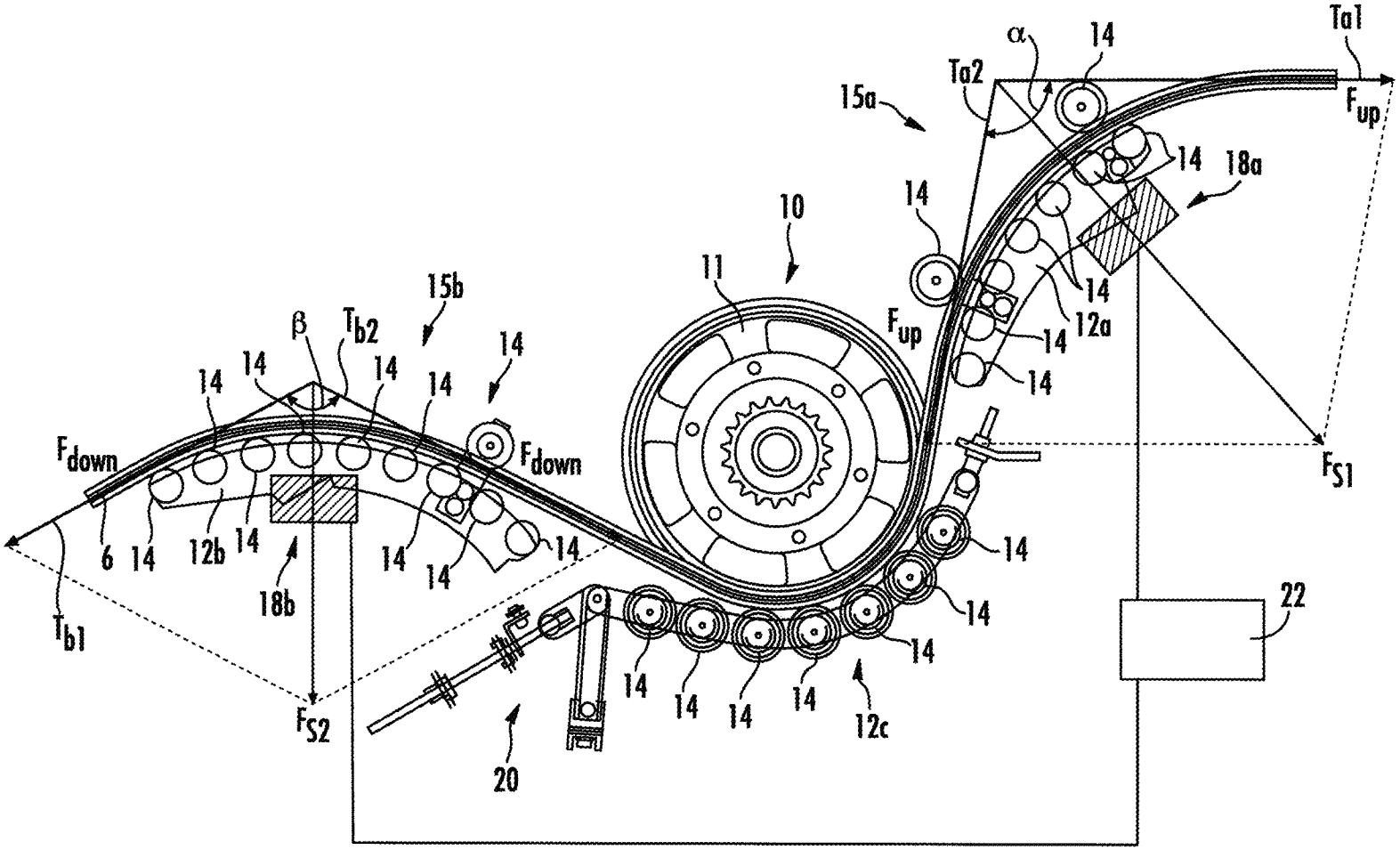
FIG. 2 shows an enlarged view of a section of a handrail element.

FIG. 2 in particular depicts an additional third guide rail 12*c*, which is not shown in FIG. 1. Each of the guide rails 12*a*, 12*b*, 12*c* is provided with a plurality of rollers 14, which are configured for supporting and guiding the handrail element 6 with low friction.

The third guide rail 12*c* is arranged next to the drive wheel 11. The third guide rail 12*c* is curved and extends along a section of the outer periphery of the drive wheel 11. A section of the handrail element 6 is sandwiched between the outer periphery of the drive wheel 11 and the rollers 14 attached to the third guide rail 12*c*. A tension mechanism 20 urges the third guide rail 12*c* against the handrail element 6 in order to enhance the engagement between the handrail element 6 and the drive wheel 11.

In the embodiment shown in FIGS. 1 and 2, with respect to the direction of movement of the handrail element 6, the first guide rail 12*a* is arranged on the right side of the drive wheel 11, and the second guide rail 12*b* is arranged on the left side of the drive wheel 11.

The first and second guide rails 12*a*, 12*b* both have an arcuate shape. This results in curved portions 15*a*, 15*b* of the travel path of the handrail element 6 when passing the first and second guide rails 12*a*, 12*b*.

The guide rails 12*a*, 12*b* are supported on the truss 5 by appropriate support structures, which are not shown in FIG. 2. A force sensor 18*a*, 18*b* is arranged between each of the guide rails 12*a*, 12*b* and the corresponding support structure, respectively.

Each force sensor 18*a*, 18*b*, which may be a load cell or a strain gauge, is configured for detecting a force $F_{S1}$, $F_{S2}$, which is exerted by the handrail element 6 on the respective guide rail 12*a*, 12*b* in a plane spanned by the upper conveying portion 16*a* and the lower return portion 16*b*, i.e. in the plane which is parallel to the plane of FIGS. 1 and 2 and which extends through the handrail element 6. The forces $F_{S1}$, $F_{S2}$ detected by the force sensors 18*a*, 18*b* are oriented in a direction transverse, in particular orthogonal, to the direction of movement of the handrail element 6 when passing the respective force sensor 18*a*, 18*b*.

The forces $F_{S1}$, $F_{S2}$ detected by the force sensors 18*a*, 18*b* are representative for the handrail driving forces $F_{up}$, $F_{down}$ acting along the longitudinal direction of the handrail element 6 when it is driven by the handrail drive 10/*drive* wheel 11.

In particular, the force $F_{S1}$, $F_{S2}$, which is detected upstream of the drive wheel 11, i.e. before the handrail element 6 passes the drive wheel 11, is representative for the handrail driving force $F_{up}$, $F_{down}$ in the respective direction.

As the direction of movement of the handrail element 6 in the return portion 16*b* shown in FIG. 2 is opposite to its direction of movement in the conveying portion 16*a*, the first force sensor 18*a* is arranged upstream of (before) the drive wheel 11 when the handrail element 6 moves upwards in the conveying portion 16*a* and downwards in the return portion 16*b*, and the second force sensor 18*b* is arranged upstream (before) of the drive wheel 11 when the handrail element 6 moves downwards in the conveying portion 16*a* and upwards in the return portion 16*b*.

Thus, the force $F_{S1}$, which is relevant when the people conveyor 2 moves upwards, i.e. when the conveyance band 8 and the handrail element 6 move upward in the conveying portion 16*a*, is detected by the first force sensor 18*a*. Correspondingly, the force $F_{S2}$, which is relevant when the people conveyor 2 moves downwards, i.e. when the conveyance band 8 and the handrail element 6 move downward in the conveying portion 16*a*, is detected by the second force sensor 18*b*.

$F_{up}$ and $F_{down}$ may by calculated, e.g. by a calculation unit 22, which is electrically connected to the force sensors 18*a*, 18*b*, from the detected forces $F_{S1}$ and $F_{S2}$ according to the following formulas:

$$F_{up} = \frac{F_{S1}}{2 \cdot \cos\left(\frac{\alpha}{2}\right)} \quad \text{Formula 1a}$$

$$F_{down} = \frac{F_{S2}}{2 \cdot \cos\left(\frac{\beta}{2}\right)} \quad \text{Formula 1b}$$

Here, a is the angle between tangents $T_{a1}$, $T_{a2}$ aligned to the paths of the handrail element 6 before and after contacting the first guide rail 12*a*, and β is the angle between tangents $T_{b1}$, $T_{b2}$ aligned to the paths of the handrail element 6 before and after contacting the second guide rail 12*b*.

The speed v of the handrail element 6 can be determined e.g. from the rotational speed of the motor 13 or the drive wheel 11.

When the forces $F_{up}$ and $F_{down}$ and the speed v of the handrail element 6 are known, the power $P_{up/down}$, which is applied for driving the handrail 6, may be calculated, e.g. by the calculation unit 22, as follows:

$$P_{up}=v*F_{up} \quad \text{Formula 2a:}$$

$$P_{down}=v*F_{down} \quad \text{Formula 2b:}$$

Thus, exemplary embodiments of the invention allow reliably determining the power $P_{up/down}$, which is applied for driving the handrail 6, at low costs.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the dependent claims.

REFERENCES

2 people conveyor
3 lower landing zone
4 conveyance element (step)
5 truss
6 handrail element
7 balustrade
8 conveyance band
9 upper landing zone
10 handrail drive
11 drive wheel
12*a* first guide rail
12*b* second guide rail
13 motor
14 roller
15*a* curved portion of the travel path
15*b* curved portion of the travel path
16*a* conveying portion
16*b* return portion
16*c* turnaround portion
18*a* first force sensor
18*b* second force sensor
20 tension mechanism
22 calculation unit
$F_{S1}$ force detected by the first force sensor
$F_{S2}$ force detected by the second force sensor
$F_{up}$, $F_{down}$ handrail driving forces
$P_{up}$, $P_{down}$ power applied for driving the handrail
$T_{a1}T_{a2}$, $T_{b1}$, $T_{b2}$ tangents aligned to the paths of the handrail element

What is claimed is:

1. People conveyor configured for conveying passengers by at least one conveyance band travelling along a closed loop and comprising:

at least one handrail element which is configured for moving parallel to the at least one conveyance band along a travel path forming a closed loop; and at least one force sensor, which is configured for detecting a force ($F_{S1}$, $F_{S2}$) exerted by the at least one handrail element in a direction transverse to a direction of movement of the at least one handrail element and for providing a corresponding force signal;

wherein the at least one handrail element is at least partly guided by a guide rail and wherein the at least one force sensor is configured for detecting a force ($F_{S1}$, $F_{S2}$) which is exerted by the at least one handrail element onto the guide rail.

2. People conveyor according to claim 1, wherein the at least one force sensor is configured for detecting a force ($F_{S1}$, $F_{S2}$) which is oriented in a plane defined by the travel path of the at least one handrail element.

3. People conveyor according to claim 2, wherein the force ($F_{S1}$, $F_{S2}$) is orthogonal to the direction of movement of the at least one handrail element.

4. People conveyor according to claim 1, wherein the at least one conveyance band and the at least one handrail element are configured to move along a travel path comprising a conveying portion and a return portion, respectively, and wherein the at least one force sensor is arranged at the conveying portion or at the return portion of the at least one handrail element.

5. People conveyor according to claim 1, wherein the at least one force sensor is arranged at a curved portion of the travel path of the at least one handrail element.

6. People conveyor according to claim 1, wherein the at least one handrail element is a belt.

7. People conveyor according to claim 6, wherein the belt comprises a synthetic belt.

8. People conveyor according to claim 1 comprising at least one handrail drive, which is configured for driving the at least one handrail element.

9. People conveyor according to claim 1, wherein the at least one force sensor includes a mechanical or electrical force sensor, a load cell or a strain gauge.

10. People conveyor according to claim 1 comprising two handrail elements, wherein one handrail element is arranged on each lateral side of the at least one conveyance band, respectively.

11. People conveyor according to claim 1, wherein the people conveyor is an escalator comprising a plurality of steps forming the conveyance band, or wherein the people conveyor is a moving walkway comprising a plurality of pallets forming the conveyance band.

12. People conveyor according to claim 1, wherein the guide rail is provided with rollers supporting and guiding the at least one handrail element.

13. People conveyor configured for conveying passengers by at least one conveyance band travelling along a closed loop and comprising:

at least one handrail element which is configured for moving parallel to the at least one conveyance band along a travel path forming a closed loop; and at least two force sensors, which are configured for detecting a force ($F_{S1}$, $F_{S2}$) exerted by the at least one handrail element in a direction transverse to a direction of movement of the at least one handrail element and for providing a corresponding force signal;

at least one handrail drive, which is configured for driving the at least one handrail element;

wherein, in the direction of movement of the handrail element, a first force sensor of the at least two force sensors is provided on one side of the handrail drive, and a second force sensor of the at least two force sensors is arranged on the other side of the handrail drive.

14. People conveyor configured for conveying passengers by at least one conveyance band travelling along a closed loop and comprising:

at least one handrail element which is configured for moving parallel to the at least one conveyance band along a travel path forming a closed loop;

at least one force sensor, which is configured for detecting a force ($F_{S1}$, $F_{S2}$) exerted by the at least one handrail element in a direction transverse to a direction of movement of the at least one handrail element and for providing a corresponding force signal;

a handrail element power calculation unit, which is configured for calculating a driving power ($P_{up}$, $P_{down}$) which is necessary for driving the at least one handrail element based on at least one force signal provided by the at least one force sensor.

15. Method of determining the power which is necessary for driving at least one handrail element of a people conveyor, wherein the method includes:

driving the at least one handrail element;

detecting a force ($F_{S1}$, $F_{S2}$) which is exerted by the at least one handrail element in a direction oriented in a direction transverse to the direction of movement of the at least one handrail element; and calculating the driving power ($P_{up}$, $P_{down}$) which is necessary for driving the at least one handrail element from the detected force ($F_{S1}$, $F_{S2}$).

16. Method according to claim 15, wherein the method further includes selecting one of at least two force sensors for detecting the force ($F_{S1}$, $F_{S2}$).

17. Method according to claim 16, wherein the selection is based on the direction of movement of the at least one handrail element.

18. Method of claim 15, wherein the force ($F_{S1}$, $F_{S2}$) is detected in a direction orthogonal to the direction of movement of the at least one handrail element.

* * * * *